United States Patent [19]
Mares et al.
[11] 4,195,105
[45] Mar. 25, 1980

[54] FLUORINATED POLYALKYLENE POLYAMIDES AS STAIN REPELLENTS

[75] Inventors: Frank Mares, Whippany; Bryce C. Oxenrider, Florham Park, both of N.J.; Cyril Woolf, deceased, late of Morristown, N.J., by Helga Woolf, executrix

[73] Assignee: Allied Chemical Corporation, Morris Township, N.J.

[21] Appl. No.: 861,371

[22] Filed: Dec. 16, 1977

Related U.S. Application Data

[63] Continuation-in-part of Ser. No. 677,357, Apr. 15, 1976, abandoned, which is a continuation-in-part of Ser. No. 591,929, Jun. 30, 1975, abandoned.

[51] Int. Cl.[2] ..... B05D 3/02

[52] U.S. Cl. ..... 427/386; 260/348.43; 260/348.45; 260/348.47; 260/455 A; 260/465.4; 260/561 R; 8/115.6; 427/401; 427/393.4; 428/260; 428/272; 528/494; 560/169; 525/419

[58] Field of Search ..... 260/348.43, 348.45, 260/348.47, 455 A, 465.4, 561 R; 427/390 E, 386, 401; 428/474, 289, 260, 272; 560/169; 8/115.6; 528/311, 494

[56] References Cited

U.S. PATENT DOCUMENTS

| | | | |
|---|---|---|---|
| 3,555,056 | 1/1971 | Crescentini et al. | 260/404.5 |
| 3,576,019 | 4/1971 | Sweeney et al. | 260/404.5 |
| 3,646,153 | 2/1972 | Oxenrider et al. | 260/785 |
| 3,754,026 | 8/1973 | Beyleveld et al. | 260/534 M |
| 3,955,027 | 5/1976 | Vaughn | 427/390 X |

*Primary Examiner*—Michael R. Lusignan
*Attorney, Agent, or Firm*—Robert A. Harman

[57] ABSTRACT

Fluorinated poly-($C_2$ to $C_{10}$) alkylene polyamides (especially alpha, omega-triazaalkanes) in which the endmost nitrogen atoms are acylated by fluorinated carboxylic acid groups and an interior nitrogen atom is acylated by a dibasic acid moiety of the group consisting of ($C_4$ to $C_{14}$) alkane dioic acid moieties and the thiocarbonic acid moieties —C(=O)S— and —$CS_2$—; wherein per the invention, a radical is terminally attached to the acylating dibasic acid moiety, of the group —$CH_2CH_2OH$, —$CH_2CH(CH_3)OH$, —$CH_2CH(OH)CH_2X$ (X being halogen or —CN), or

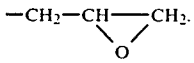

The compounds are amphipathic, behaving like surfactants when incorporated with nylon. They are prepared by broadly known methods of producing esters and thioesters of acids. The stain resistance of fibers incorporating these compounds can be improved as to durability and at least partially restored after abrasion of the fiber, by annealing.

13 Claims, No Drawings

FLUORINATED POLYALKYLENE POLYAMIDES AS STAIN REPELLENTS

CROSS-REFERENCE TO RELATED APPLICATIONS

This application is a continuation-in-part of our copending U.S. patent application Ser. No. 677,357 filed Apr. 15, 1976, now abandoned, which in turn is a continuation-in-part of then copending application Ser. No. 591,929, filed June 30, 1975, now abandoned.

BACKGROUND OF THE INVENTION

This application relates to fluorinated compositions or compounds for use as anti-soil agents in articles composed of synthetic thermoplastic, especially those composed of fibers of synthetic long-chain polyamide having recurring amide groups as an integral part of the polymer chain (hereinafter called "nylon" or "synthetic polyamide").

A broad group of polyalkylene polyamines, acylated with a fluorinated carboxylic acid having a terminal fluoroisoalkyloxyalkyl group, is disclosed as oil-repellency agents in U.S. Pat. No. 3,576,019 of Apr. 20, 1971 to R. F. Sweeney et al. Numerous illustrative polyalkylene polyamine starting materials are disclosed, including in particular di-, tri- and tetraethylene polyamines and dipropylene triamine (Col. 3, lines 1–20); and numerous illustrative fluorinated compounds of that invention are disclosed. (See Examples 1–29).

It is known (U.S. Pat. No. 3,754,026 of Aug. 21, 1973 to W. M. Beyleveld et al.) that alpha, omega triazaalkanes wherein the terminal nitrogen atoms are acylated with highly fluorinated carboxylic acid radicals, and the interior nitrogen atom is acylated with an alkane dioic acid radical, confer stain repellant properties upon synthetic resins, when incorporated therein by blending with a melt thereof. The triazaalkane starting materials include compounds such as 1,4,7-triazaheptane; 1,5,8-triazaoctane, 1,5,9-triazanonane; 1,4,11-triazaundecane; and 1,8,15-triazapentadecane (U.S. Pat. No. 3,555,056 of Jan. 12, 1971 to L. Crescentini et al., Col. 3, lines 71–75). Such polyalkylene polyamines, acylated in accordance with the above U.S. Pat. No. 3,754,026, have the necessary compatibility with e.g. synthetic polyamide substrates; but it has been found that they are rather easily extracted therefrom by cleaning operations such as laundering and steam cleaning. A technical problem accordingly was presented, to reduce the extractability of such compound in laundering without unfavorably affecting its resistance to dry cleaning solvents and its compatibility with the substrate such as synthetic polyamide.

SUMMARY OF THE INVENTION

In accordance with the present invention, agents are provided which have a high degree of repellency for both water and oil, and which are retained on and in a fiber or other article of synthetic polyamide through numerous launderings and dry cleanings. The present compounds can be incorporated with the synthetic polyamide, in particular with nylon fiber, by contacting the compound, as a solution or dispersion in a liquid medium, with the nylon surface.

A further particular advantage of the anti-soil agents of this invention is that they allow satisfactory dyeing of a fiber, or article prepared from such fiber, in which these agents have been previously incorporated; and can also be applied together with a dyestuff from the same bath, with satisfactory results.

Our invention, broadly, comprises a compound capable of imparting oil and water resistance to nylon fiber upon applying said compound to the surface of said fiber by contact of a solution or dispersion of the compound in liquid medium with the surface of the fiber and then annealing the resulting fiber; said compound being a poly-($C_2$ to $C_{10}$) alkylene polyamine containing a primary or methyl substituted nitrogen at each end of a chain, said terminal nitrogen atoms being acylated by fluorinated carboxylic acid groups; and said polyalkylene polyamine containing at least one interior nitrogen atom, acylated by a dibasic acid moiety of the group consisting of ($C_4$ to $C_{14}$) alkane dioic acid moieties and the thiocarbonic acid moieties —C(=O)S— and —$CS_2$—; which compound comprises a radical, terminally attached to said acylating dibasic acid moiety, of the group consisting of the esterifying radicals —$CH_2CH_2OH$, —$CH_2CH(CH_3)OH$, —$CH_2CHOHCH_2X$ (X being halogen or cyano), or

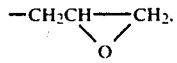

Our new compounds can accordingly be represented by formulas as follows:

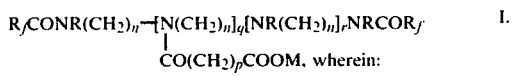

$$R_fCONR(CH_2)_n-[N(CH_2)_n]_q[NR(CH_2)_n]_rNRCOR_f \quad \text{I.}$$
$$\qquad\qquad\qquad\qquad | \qquad\qquad\qquad\ after three standard home laundry cycles and after three standard dry cleaning cycles.

Also included in our invention is the process of incorporating the foregoing compounds with fiber, comprising contacting a solution or dispersion of the compound in liquid medium with the surface of the fiber and then annealing the resulting fiber (heating above the glass transition temperature sufficiently to develop water and oil repellency). Advantageously such process will include a dyeing treatment before, during or after the annealing step.

The permanence of incorporation of the compound with nylon fiber is enhanced, in accordance with a further feature of the invention, by impregnating the fiber, especially a fabric, with a polyfunctional epoxide compound or isocyanate and with a compound of the invention containing at least one hydroxyl group and with a tertiary amine as catalyst, and heating the resulting fiber; whereby the compound is insolubilized by in situ formation of chemical bonds between such hydroxyl groups and the epoxide or isocyanate groups.

DETAILED DESCRIPTION AND PREFERRED EMBODIMENTS

In preferred embodiments of our compounds, the polyalkylene polyamine moiety is a triazaalkane having its three nitrogen atoms arranged in a straight carbon-nitrogen chain, terminated at both ends by nitrogen atoms and having a $C_2$ to $C_4$ alkylene radical separating the interior nitrogen atom from each of the terminal nitrogen atoms.

The fluorinated radicals $R_f$ in the groups $R_fCO$, acylating said terminal nitrogen atoms of the triazaalkane chain, have preferably the formula $(F(CF_2)_m$ or $(CF_3)_2CFO(CF_2)_{m'}$ wherein independently at each occurrence, m is an integer from 5 to 10, and m' is an integer from 2 to 10.

The dibasic acid moiety, acylating the interior nitrogen atom of the triazaalkane is preferably glutaryl.

Preferably the esterifying radical, M of Formula I and of Formula II above, is the chloro- or bromohydryl radical $CH_2CH(OH)CH_2X$ (X being Cl or Br) or the glycidyl radical

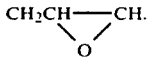

As above noted, numerous polyalkylene polyamides terminally acylated with fluorinated carboxylic acids, all of which we consider to be suitable starting materials for preparation of the compounds of this invention, are disclosed in U.S. Pat. Nos. 3,576,019 and 3,754,026. Other related compounds and methods for production thereof will be obvious to the skilled organic chemist. Accordingly, it is not considered necessary to present a list of such compounds.

The starting materials for our invention, wherein an alkane dioic acid is the acylating group on an interior nitrogen atom of the terminally acylated polyalkylene polyamide, can be prepared as taught in U.S. Pat. No. 3,754,026 (Col. 3, line 38—Col. 4, line 75 and Examples 1, 2, 3, 6 and 7).

When the group attached to the interior nitrogen atom is a thiocarbonic acid moiety, that starting material can be prepared (as the sodium salt) by contacting the terminally acylated polyalkylene polyamide with carbonyl sulfide or carbon disulfide and sodium hydroxide in a solvent, thereby forming the sodium salt of the desired thiocarbonic acid compound, having at the interior nitrogen atom of the polyamide the structure NCOSNa or NCSSNa.

The compounds of Formula I of our invention can be obtained from the acylated starting materials by conventional reactions of the free carboxyl group, viz: (a) with ethylene or propylene oxide for $—CH_2CH_2OH$ or $—CH_2CH(CH_3)OH$, respectively, as radical "M" of the above Formula I; (b) with excess epihalohydrin

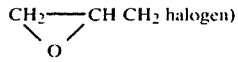

in acetonitrile at 60° C., catalyzed by tertiary amine, for $—CH_2CHOHCH_2X$ (X=halogen); (c) by substitution of cyano group for chlorine or bromine of (b) via reaction with NaCN for $—CH_2CHOHCH_2CN$; and (d) for

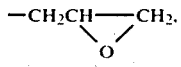

reaction of the carboxy group with allyl alcohol in trifluoroacetic acid anhydride, followed by epoxidizing the double bond by e.g., m-chloroperbenzoic acid in dichloromethane solvent at room temperature.

Our compounds of Formula II can be obtained from the sodium salt of the N-thiocarbonic acid, by reaction with ethylene chlorohydrin or ethylene bromohydrin to form the thioester group $—SCH_2CH_2OH$; and by reaction with propylene chlorohydrin or bromohydrin to form the thioester group $—SCH_2CH(CH_3)OH$. By reaction with allyl chloride, the N-thiocarbonic acid sodium salt forms the unsaturated ester group $—SCH_2CH{=}CH_2$ from which, by epoxidizing the double bond as above indicated for Formula I (d), the thioglycidyl ester group

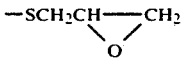

is obtained. This epoxide can in turn be converted to a halohydryl radical by reaction with hydrogen halide. The chloro- or bromohydryl radical thus produced can be converted to cyanohydryl radical by reaction with NaCN as for Formula I(e) above. Alternatively the above thioglycidyl ester group

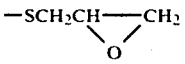

can be obtained by reaction of the sodium salt of the above thiocarbonic acid with epichlorohydrin in solution at about 50° C., filtration, and evaporation of volatiles.

The fibers of this invention can be obtained by blending or coating nylon pellets with an additive compound of this invention and thereafter using conventional melt spinning procedure. A preferred alternative allowing incorporation of additive with fibers, without preparing a special melt spinning charge containing the additive, is to apply the additive to the surface of the fiber from liquid medium as a solution or dispersion (including emulsions), for example by use of a roll wetted with such solution or dispersion and contacting the fiber; or by brushing, dipping or spraying the fiber, or fabric prepared therefrom, with the solution or dispersion. The weight of additive on weight of fiber or fabric will be adjusted by the usual methods to an effective level for the particular purpose, which usually will range from about 0.1% to about 1%. The liquid medium can be an organic solvent of the additive (more specifically a polar organic solvent); or water plus emulsifying agent such as a combination of N-hexadecyltrimethylammonium bromide and a non-ionic surfactant plus polar organic solvent, whereby to obtain an emulsion of the additive in a polar organic solvent as carrier.

To promote satisfactory permanence of the repellency conferred on nylon fibers by incorporation of the additive, it is usually necessary to anneal the fiber/additive combination, i.e. to heat substantially above the glass transition temperature of the nylon but not so high or so long that the nylon or additive is seriously degraded. Typical temperatures found effective are in the range of 100° C. to 230° C. The annealing can be in an atmosphere such as nitrogen, circulating air, or steam. Such annealing also tends to restore the repellency of the subject fibers if reduced, e.g. by abrasion. We theorize that the annealing causes the additive to migrate from within the fiber and concentrate at the surface.

To enhance permanency of the additive effect using hydroxyl substituted additives, a polyfunctional epoxide such as triglycidyl trimellitate as one specific example, or a polyfunctional isocyanate can be included in the liquid treating medium along with a tertiary amine catalyst to bring about reaction of the hydroxyl groups with the polyfunctional groups upon heating of the treated fiber. Thereby the additive is insolubilized in situ at and near the surface of the fiber.

The following Examples are illustrative of our invention and of the best mode contemplated by us for carrying out the invention but are not to be interpreted as limiting thereof.

Example 1-6 illustrate in detail the preparation of compounds of our invention.

Fibers of the invention are illustrated by the testing described following the Examples. We consider the performance illustrated by Runs 4, 5 and 6 of the Table to be marginal in terms of providing the performance contemplated for this invention.

EXAMPLE 1

Preparation of the chlorohydrin of 1,7-Bis(4-perfluoroisopropoxy-perfluorobutyryl)-1,4,7-triazaheptane monoglutaramide (A compound of Formula I)

To a dry 150 ml. flask is added 30 gms. of 1,-bis(4-perfluoroisopropoxy-perfluorobutyryl)-1,4,7-triazeheptane monoglutaramide (prepared as in Example 2 of U.S. Pat. No. 3,754,026 above cited), 30 ml. dimethylformamide, 15 ml. epichlorohydrin and 0.1 ml. of triethylamine as catalyst. The reaction mixture is heated to a temperature of 60° C. for a period of 23 hours. The reaction is followed by periodically determining the unreacted carboxyl groups by titration of a sample taken from the reaction mixture. The volatiles are removed by flash operation employing a temperature of 75° C. and less than about 1 mm Hg, yielding a product which is a clear, light yellowish brown oil weighing about 35 gms. Analysis of the product confirms the structure as corresonding to Formula I above, wherein $R_f$ at both occurrences is $(CF_3)_2CFOCF_2CF_2CF_2$—, R at both occurrences is hydrogen, q is unity and r is zero, $(CH_2)_n$ at both occurrences is the ethylene radical, $(CH_2)_p$ is the 1,3-propylene radical, and M is —$OCH_2CH(OH)CH_2Cl$.

EXAMPLE 2

Preparation of the chlorohydrin of 1,7-Bis(perfluorooctoyl)-1,4,7-triazaheptane monoglutaramide (A compound of Formula I)

Following the procedure of Example 1 of U.S. Pat. No. 3,754,026 above cited, n-1,7-bis(perfluoro-n-octoyl)-1,4,7-triazaheptane monoglutaramide is produced (from 1,7-acylated n-1,4,7-triazaheptane, 1,7-acylated by the fluorinated acid $F_3C(CF_2)_6COOH$, generally as in U.S. Pat. No. 3,576,019 above cited). This monoglutaramide precursor (2 gms) and 25 ml. of dimethylformamide, 10 ml. of epichlorohydrin and 0.08 ml. triethylamine as catalyst are charged into a 250 ml. dried flask. The reaction mixture is heated to a temperature of 60° C. for a period of 24.5 hours, with the reaction mixture being periodically analyzed for carboxyl concentration. At the end of the above period, the volatile components are removed by flash evaporation employing a temperature of 75° C. and a pressure of 1 mm Hg. The product which is obtained is an off-white solid and is found to comprise 24.5 gms. of a compound of Formula I above, wherein R at both occurrences is n-$CF_3(CF_2)_6$— and otherwise the structure is as in Example 1 above.

EXAMPLE 3

Preparation of the 1,6-hexamethylenediamide of 1,7-Bis(4-perfluoroisopropoxy-perfluorobutyryl)-1,4,7-triazaheptane monoglutaramide (Comparison)

To a dried reactor is added 9.4 gms of 1,4-bis(4-perfluoroisopropoxy-perfluoro-n-butyryl)-n-1,4,7-triazaheptane monoglutaramide as used in Example 1 above and 25 ml. of dry acetonitrile to form a suspension. To this suspension at room temperature is added 0.8 ml. of 1,6-diisocyanatohexane, and the resulting mixture is then stirred for one hour and refluxed at a temperature of 82° C. for an addtional period of ½ hour to ensure complete reaction. The solvent is then removed using a rotary evaporator apparatus at a maximum temperature of 125° C. and pressure of 1 mm Hg. Heating of the resulting residue is continued for a two hour period at 120° to 125° C. and about 2 mm Hg until carbon dioxide evolution has ceased. The product is recovered as a light brown solid (0.6 gms) that has a flow point of from 64° to 66° C. Analysis of the product confirms the structure as corresponding to Formula II above, wherein $R_f$ at all occurrences is $(CF_3)_2CFOCF_2CF_2CF_2$—, q is unity and r is zero, $(CH_2)_n$ at all occurrences is the ethylene radical, $(CH_2)_p$ at both occurrences is the 1,3-propylene radical, and $(CH_2)_s$ is the 1,6-hexylene radical.

EXAMPLE 4

Preparation of tetramethylated derivative of the compound of Example 3

(Comparison)

One gram of the product obtained in Example 3 is dissolved in 10 ml. of dry acetone. Potassium carbonate (0.35 gms) and dimethyl sulfate (0.19 ml.) are added and the reaction mixture is heated at reflux temperature (approximately 56° C.) for a period of four hours. After this period of time, the reaction mixture is cooled to room temperature and filtered and acetone is removed by flash evaporation at 100° C. and 1 mm Hg. Analysis by NMR indicates the presence of four methyl groups per molecule. The methyl groups are found to be randomly attached to amide linkages, displacing $\frac{2}{3}$ of the hydrogens which comprise the R groups in the product of Example 3.

EXAMPLE 5

Preparation of the N-thioglycidyl ester of 1,7-bis(perfluorooctoyl)-1,4,7-triazaheptane (A compound of Formula II)

To 10 parts of n-1,7-bis(perfluoro-n-octoyl)-1,4,7-triazaheptane, obtained as outlined in Example 2 above, is added 50 ml. of isopropanol and an aqueous solution containing 0.5 parts sodium hydroxide in five parts by volume of water. The reaction mixture is cooled to from 0° to 5° C. in an ice-water bath. Carbon disulfide (0.7 ml.) is slowly added with continued stirring and the reaction mixture allowed to warm to room temperature. The reaction mixture is then stirred at room temperature for 18 hours, producing a hazy, pale yellow solution with a small amount of undissolved solids. The solution is filtered and used directly in the next step without purification.

The reaction mixture from the previous step is added over a 15 minute period to a solution containing 25 ml. isopropanol and 25 ml. of epichlorohydrin and is allowed to react for one hour at room temperature and then for two hours at 50° C. After cooling to room temperature the mixture is filtered, and the filtrate is treated by flash evaporation to remove the volatile solvents. The product (11.4 gms.) thereby obtained is found to melt at approximately 125° to 135° C. The structure is confirmed by subsequent analysis as that of the desired thioglycidyl ester wherein $R_f$ at both occurrences is n—$CF_3(CF_2)_6$—, R at both occurrences is hydrogen, q is unity and r is zero, $(CH_2)_n$ at both occurrences is the ethylene radical, Y is sulfur, and M is

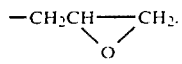

EXAMPLE 6

(A compound of Formula II)

Following the procedure of Example 5 an additive wherein both radicals $R_f$ of Formula II above are $(CF_3)_2CFOCF_2CF_2CF_2$— is obtained, having otherwise the structure of the compound of Example 5 above.

Testing

The table below shows results of testing oil repellency of cloth from polycaproamide yarn, impregnated with compounds of this invention by immersion in a solution thereof (in acetone or isopropanol) of concentration adjusted to take up the indicated weight percent of the compound (based on weight of the cloth), after squeezing to remove excess liquid. The samples were air dried and then annealed for 30 minutes in a circulating air oven at the indicated temperatures.

Oil repellency was rated on a scale of 0 to 8 by use of eight test liquids of surface energies 32.8 dynes/cm. (Rating=1) down to 20.0 dynes/cm. (Rating=8). The rating for the cloth is that of the highest rated liquid which does not wet the cloth (American Association of Textile Colorists and Chemists Test No. 118-1966).

The cloth was subjected to repeated standard home laundering ("HL") cycles each consisting of washing in a heavy duty 6-cycle automatic washer using a 12-minute hot (40° C.) wash with one cup of detergent (DASH of Proctor & Gamble Co.) at load of 3 pounds with double rinse, followed by drying for 30 minutes in an automatic dryer at 80°–85° C. Also such cloth was subjected to repeated standard dry cleaning ("DC") cycles using 150 ml. of perchloroethylene and 100 steel balls ($\frac{1}{4}$ inch diameter), in the procedure of AATCC Test No. 86-1970. Oil Repellency was tested after successive cycles to determine the permanence of the treatment.

Water repellency and permanence thereof were also investigated by AATCC Test N. 22-1967 wherein a rating of 70 to 90 is good, and 90 to 100 is outstanding.

In the table, the column headed "Cmpd. No." lists the particular number of the Example (above) showing preparation of the compound used.

Table

| Run No. | Cmpd. No. | Wgt % of Cmpd. | Anneal Temp. °C. | Oil Repellency After HL Cycles 0 | 1 | 3 | 5 | 6 | 7 | 8 | 9 | 10 | 11 | 12 |
|---|---|---|---|---|---|---|---|---|---|---|---|---|---|---|
| Part (A) | | | | | | | | | | | | | | |
| 1 | 2 | 0.25 | 150 | 8 | 7 | 7 | 6 | 6 | 4 | 4 | 1 | 0 | — | — |
| 2 | " | 0.5 | 150 | 8 | 7 | 7 | 7 | 7 | 7 | 6 | 6 | 5 | 5 | 3 |
| 3 | " | 0.5 | 140 | 7 | 7 | 7 | 7 | 6 | 6 | 5 | 4 | 4 | — | — |
| 4 | 1 | 0.5 | 150 | 5 | 5 | 4 | 1 | — | — | — | — | — | — | — |
| 5 | 3 | 0.5 | 150 | 5 | 5 | 4 | 3 | 1 | 0 | — | — | — | — | — |
| 6 | 4 | 0.5 | 150 | 5 | 5 | 4 | 4 | 0 | — | — | — | — | — | — |
| 7 | 5 | 0.5 | 150 | 6 | 6 | 5 | 4 | 2 | 1 | — | — | — | — | — |
| 8 | 6 | 0.5 | 150 | 6 | 6 | 6 | 6 | 6 | 4 | 4 | 4 | 3 | — | — |
| Part (B) | | | | Water Repellency After HL Cycles | | | | | | | | | | |
| | | | | 0 | 1 | 3 | 4 | 5 | 7 | 8 | 9 | 10 | | |
| 9 | 2 | 0.5 | 140 | 80 | 70 | 70 | 70 | 70 | 70 | 50 | 50 | 0 | | |
| Part (C) | | | | Oil Repellency After DC Cycles | | | | | | | | | | |

Table-continued

| | | | | 0 | 1 | 3 | 4 | 5 | 7 | 8 | 9 | 10 |
|---|---|---|---|---|---|---|---|---|---|---|---|---|
| 10 | 2 | 0.5 | 140 | 8 | 7 | 7 | 7 | 7 | 7 | 7 | 7 | 7 |

Note: The treated nylon-6 in Runs 1, 2 and 4 was an oxford weave, and in the remaining runs was a taffeta weave.

We claim:

1. A compound capable of imparting oil and water resistance to nylon fiber upon applying said compound to the surface of said fiber by contact of a solution or dispersion of the compound in liquid medium with the surface of the fiber and then annealing the resulting fiber; said compound being a poly-($C_2$ to $C_{10}$) alkylene polyamine containing a primary or methyl substituted nitrogen at each end of a chain, said terminal nitrogen atoms being acylated by fluorinated carboxylic acid groups; and said polyalkylene polyamine containing at least one interior nitrogen atom, acylated by a dibasic acid moiety of the group consisting of ($C_4$ to $C_{14}$) alkane dioic acid moieties and the thiocarbonic acid moieties —C(=O)S— and —$CS_2$—; wherein the improvement comprises a radical, terminally attached to said acylating dibasic acid moiety, of the group consisting of the esterifying radicals —$CH_2CH_2OH$, —$CH_2CH(CH_3)OH$, —$CH_2CHOHCH_2X$ (X being halogen or cyano), or

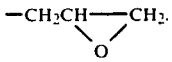

2. Compound of claim 1 having the formula:

$$R_fCONR(CH_2)_n[\underset{\underset{CO(CH_2)_pCOOM}{|}}{N}(CH_2)_n]_q[NR(CH_2)_n]_rNRCOR_f$$

wherein:

(1) Independently at each occurrence, $R_f$ is a highly fluorinated radical containing at least two and up to 20 perfluorinated carbon atoms;
(2) Independently at each occurrence, R is hydrogen or methyl;
(3) Independently at each occurrence, n is an integer from 2 to 10; and $(CH_2)_n$ is a straight chain or a chain containing propyl substituent radicals;
(4) q is 1, 2 or 3;
(5) r is 0, 1 or 2 and q+r is 1, 2 or 3;
(6) p is an integer from 2 to 12;
(7) M is —$CH_2CH_2OH$ or —$CH_2CH(CH_3)OH$, or is —$CH_2CH(OH)CH_2X$ (X being halogen or —CN), or is

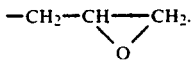

3. Compound of claim 1 wherein the polyalkylene polyamine moiety is a triazaalkane having its three nitrogen atoms arranged in a straight carbon-nitrogen chain, terminated at both ends by nitrogen atoms and having a $C_2$ to $C_4$ alkylene radical separating the interior nitrogen atom from each of the terminal nitrogen atoms; and wherein the fluorinated radicals in the carboxylic acid groups acylating said terminal nitrogen atoms have the formula $F(CF_2)_m$ or $(CF_3)_2CFO(CF_2)_{m'}$, wherein independently at each occurrence, m is an integer from 5 to 10 and m′ is an integer from 2 to 10.

4. Compound of claim 3 wherein such fluorinated radicals are straight chain radicals and wherein the dibasic acid moiety is glutaryl and the radical terminally esterifying that moiety is chlorohydryl, bromohydryl, or glycidyl.

5. A water and oil repellent nylon fiber having incorporated therewith as an additive, at least one compound of claim 3, in which fiber the repellency is retained at least in substantial part after three standard home laundry cycles and after three standard dry cleaning cycles.

6. Fiber of claim 5 incorporating an additive compound wherein $(CF_2)_m$ and $(CF_2)_{m'}$ are straight chain radicals and wherein the dibasic acid moiety is glutaryl and the radical terminally acylating that moiety is chlorohydryl, bromohydryl, or glycidyl.

7. Fiber of claim 6 composed of poly-E-caproamide.

8. Fiber of claim 5 incorporating an additive compound wherein the dibasic acid moiety is the thiocarbonic acid moiety, —$CS_2$—, and the radical terminally attached thereto is the glycidyl radical,

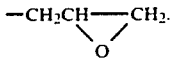

9. Process of incorporation, with a nylon fiber, a compound of claim 3 comprising contacting a solution or dispersion of said compound in liquid medium with the surface of the fiber and then annealing the resulting fiber, whereby the fiber acquires repellency against water and oil.

10. Process of claim 9 including a dyeing treatment before, during or after the annealing step.

11. Process of claim 10 wherein such nylon fiber is composed of poly-E-caproamide.

12. Process of claim 9 wherein the fiber is composed of poly-E-caproamide and wherein the fiber, in the form of a fabric, is impregnated with a polyfunctional epoxide compound or isocyanate and with a tertiary amine catalyst, included in the liquid treating medium.

13. Compound of claim 2 wherein M is —$CH_2CH_2OH$ or —$CH_2CH(CH_3)OH$ or is —$CH_2CH(OH)CH_2X$ (X being halogen).

* * * * *